US006637511B2

(12) United States Patent
Linaker

(10) Patent No.: US 6,637,511 B2
(45) Date of Patent: Oct. 28, 2003

(54) BOREHOLE CASING CENTRALIZER

(75) Inventor: Brian Robert Linaker, Bunbury (AU)

(73) Assignee: Kwik-Zip Pty. Ltd. (AU)

( * ) Notice: Subject to any disclaimer, the term of this patent is extended or adjusted under 35 U.S.C. 154(b) by 0 days.

(21) Appl. No.: 09/849,236

(22) Filed: May 7, 2001

(65) Prior Publication Data

US 2001/0037882 A1 Nov. 8, 2001

(30) Foreign Application Priority Data

May 8, 2000 (AU) ..... PQ7375

(51) Int. Cl.[7] ..... E21B 17/10

(52) U.S. Cl. ..... 166/241.7; 166/241.1; 166/241.6; 166/213

(58) Field of Search ..... 166/241.1, 241.7, 166/241.6, 213

(56) References Cited

U.S. PATENT DOCUMENTS 3,749,168 A * 7/1973 Hall, Sr. ..... 166/241.7
4,269,269 A * 5/1981 Wilson ..... 166/241.7
4,520,869 A * 6/1985 Svenson ..... 166/241.7
4,909,322 A * 3/1990 Patterson et al. ..... 166/241.7
6,367,556 B1 * 4/2002 Moore ..... 166/378

OTHER PUBLICATIONS

Weatherford Cementing Products Catalog, 1995, 11 pages.
Excerpts from Weatherford Products & Services Catalog, 3 pages. (Undated).
RACI, Spacers for Pipeline Cased Crossings, 9 pages. (Undated).

* cited by examiner

*Primary Examiner*—David Bagnell
*Assistant Examiner*—G M. Collins
(74) *Attorney, Agent, or Firm*—Rothwell, Figg, Ernst & Manbeck, PC

(57) ABSTRACT

A borehole casing centralizer segment (1) including a first collar portion (3), a second collar portion (5), and bows (7) extending between the first collar portion (3) and the second collar portion (5). First connectors (9) are provided at first locations of the first collar portion (3) and the second collar portion (5), respectively. The first connections (9) are engageable with the second connectors (11) of the same or another centralizer segment (1). In this way, one or more centralizer segments (1) are connectable together to form a centralizer around a borehole casing.

27 Claims, 7 Drawing Sheets

BOREHOLE CASING CENTRALIZER

FIELD OF THE INVENTION

The present invention relates to a centralizer segment and a centralizer formed of one or more centralizer segments.

The centralizer may be used to centralise a borehole casing. Such borehole casings may be used, for example, in water wells, oil wells and gas wells.

DISCLOSURE OF THE INVENTION

In accordance with one aspect of the present invention, there is provided a centralizer segment 200 comprising a first collar portion 202, a second collar portion 204, bow means 206 extending between said first collar portion 202 and said second collar portion 204, first connection means 208 provided at first locations of said first collar portion 202 and said second collar portion 204, respectively, second connection means 210 provided at second locations of said first collar portion 202 and said second collar portion 204, respectively, wherein said first connection means 208 are engagable with said second connection means 210 of the same or another centralizer segment 200 such that one or more said centralizer segments 200 are connectable together to form a centralizer around a borehole casing.

Preferably, said first and second connection means 210 allow the relative positional engagement between said first and second connection means 208, 210 to be selected.

Preferably, said first connection means 208 comprises teeth provided on said first and second collar portions 202, 204 on a first face of said centralizer segment 200 and said second connection means 210 comprises pawl means provided on said first and second collar portions 202, 204 on a second face of said centralizer segment 200.

Preferably said second connection means 210 further comprises guide means for receiving first and second collar portions 202, 204 of a said centralizer segment 200.

Preferably, said first and second collar portions 202, 204 are provided with lug members on a face of said centralizer segment 200 that, in use, faces away from the borehole casing.

The lug members can be used to tighten the centralizer segment 200 around the borehole casing.

Preferably, said bow means 206 is flexibly resilient.

Preferably, said bow means 206 is curved in the direction between said first and second collar portions 202, 204.

Preferably, said bow means 206 extends between said first and second collar portions 202, 204 intermediate the locations of said first and second connection means 208, 210.

Preferably, agitation promoting means is provided on said centralizer segment 200 to promote agitation of grout injected into a borehole.

Preferably, said agitation promoting means comprise rib members provided on said bow means 206.

Preferably, said rib members are provided on a face of said centralizer segment 200 that, in use, faces the borehole casing.

Preferably, at least one of said rib members is provided with at least one enlarged portion.

Preferably, said bow means 206 comprises at least two strap members extending between said first and second collar portions 202, 204.

Preferably, said first and second collar portions 202, 204 are substantially parallel.

Preferably, said first and second collar portions 202, 204 are provided as strap members.

Preferably, said centralizer segment 200 is made of a corrosion resistant material.

In accordance with a second aspect of the present invention, there is provided a centralizer for a borehole casing comprising a centralizer segment 200, as hereinbefore described, connected together via said first and second connection means 208, 210 around a borehole casing.

The centralizer may comprise at least two centralizer segments 200 connected together via said first and second connection means 208, 210 around a borehole casing.

In accordance with a third aspect of the present invention, there is provided a centralizer for a borehole casing comprising at least two centralizer segments, 200 as hereinbefore described, connected together via said first and second connection means 208, 210 around a borehole casing.

BRIEF DESCRIPTION OF THE DRAWINGS

The present invention will now be described, by way of example, with reference to the accompanying drawings, in which.

BEST MODE(S) FOR CARRYING OUT THE INVENTION

Figure 1:
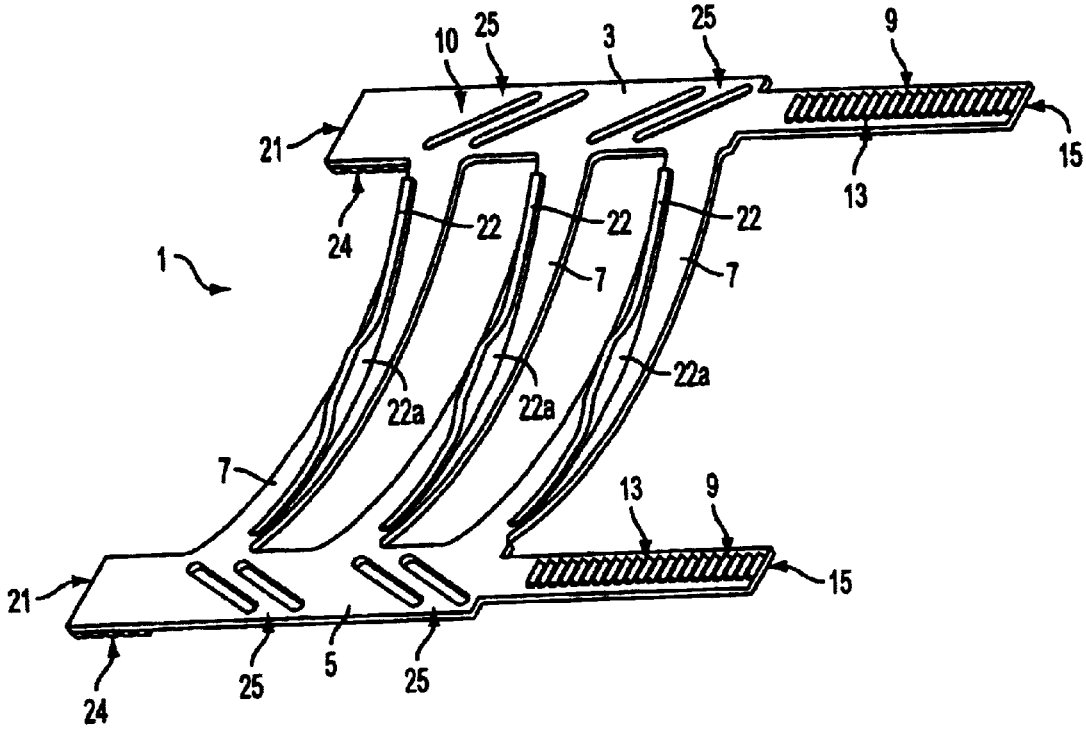
FIG. 1 is a first perspective view of an embodiment of a centralizer segment in accordance with one aspect of the present invention.
Figure 2:
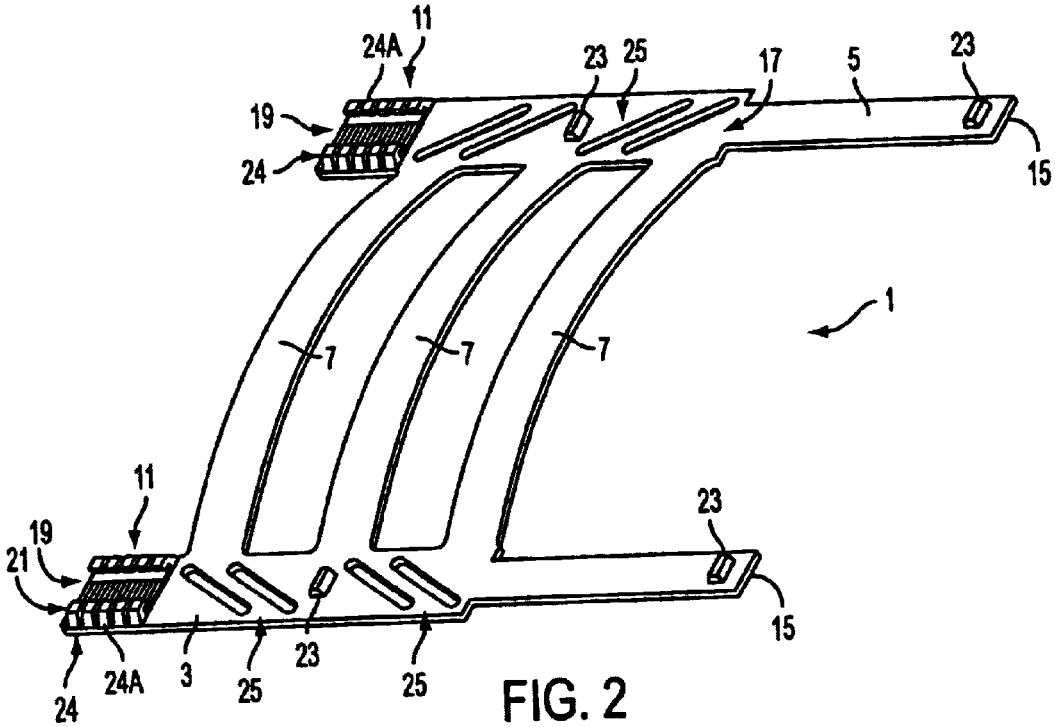
FIG. 2 is a second perspective view of the centralizer segment shown in FIG. 1.
Figure 3:
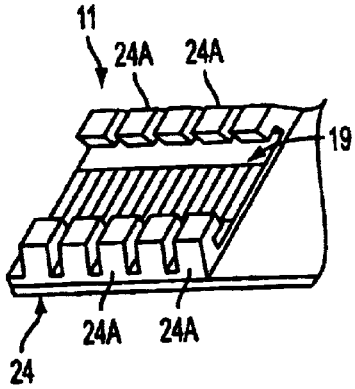
FIG. 3 is a detailed view of a second connector of the centralizer segment shown in FIG. 2.
Figure 4:
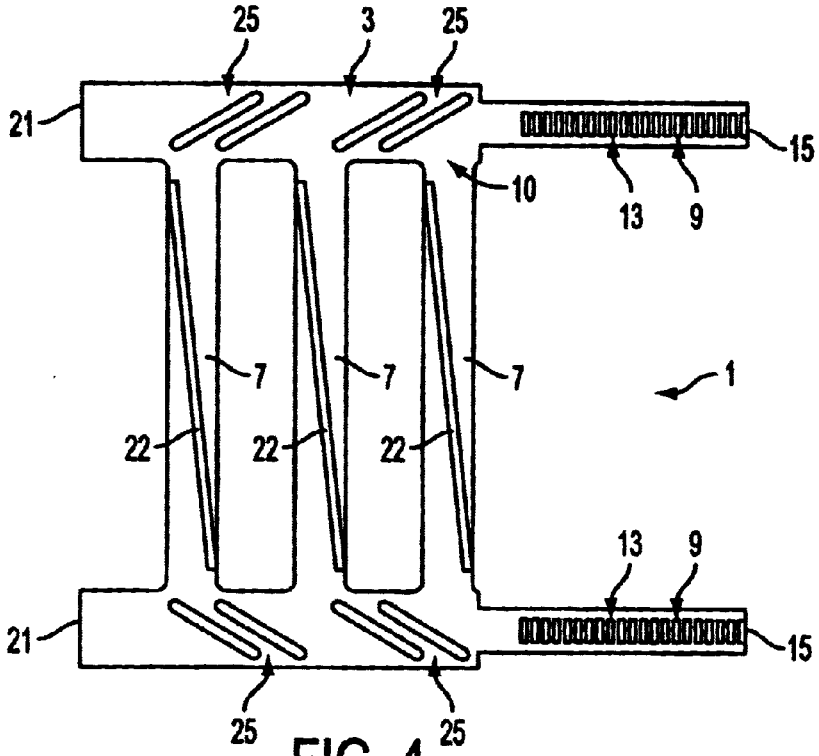
FIG. 4 is a first plan view of the centralizer segment as shown in FIG. 1.
Figure 8:
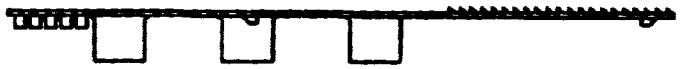
FIG. 8 is a side view of the centralizer segment shown in FIG. 6.
Figure 6:
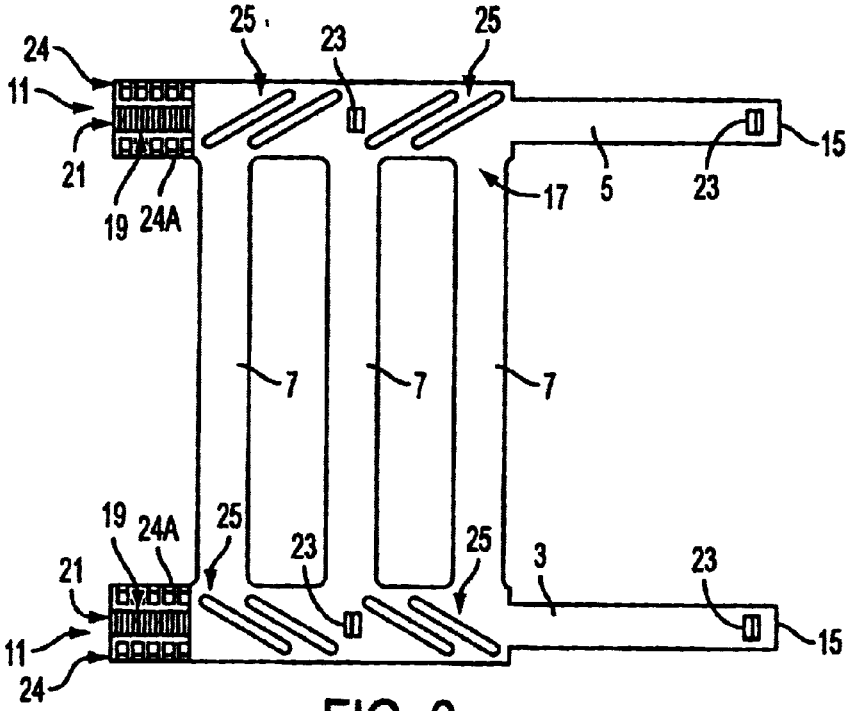
FIG. 6 is a second plan view of the centralizer segment as shown in FIG. 2.
Figure 5:
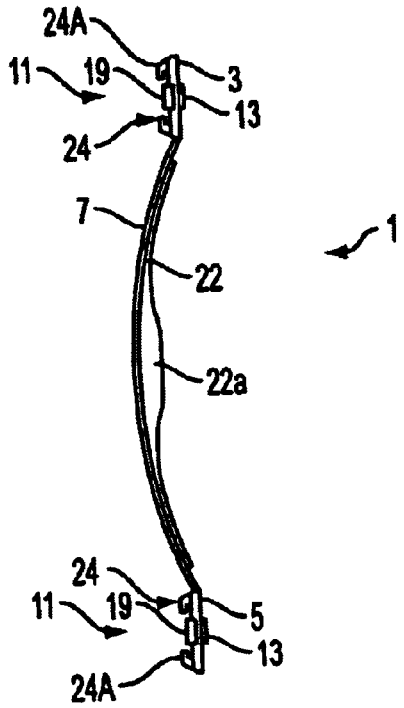
FIG. 5 is an end view of the centralizer segment shown in FIG. 4.
Figure 7:
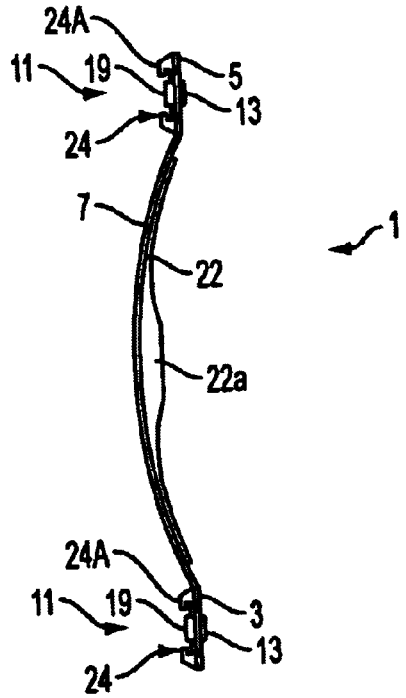
FIG. 7 is an end view of the centralizer segment shown in FIG. 6.

In a first embodiment of a centralizer according to the present invention, two or more centralizer segments are connected together to form the centralizer around a borehole casing. An embodiment of a centralizer segment that can be used to form such a centralizer and the centralizer formed thereby is described herein in further detail with reference to FIGS. 1–10 of the drawings.

In a second embodiment of a centralizer according to the present invention, a single centralizer segment is connected together, i.e. connected to itself, to form the centralizer around a borehole casing.

The first embodiment of the centralizer is used with borehole casings having medium to large diameters, whilst the centralizer of the second embodiment is used with borehole casings having small diameters. The centralizer segment used to form a centralizer according to the second embodiment is similar to the centralizer segment used to form a centralizer according to the first embodiment except that it is smaller in size since it is used with borehole casings having small diameters.

The present invention will now be further described with reference to FIGS. 1–10 of the accompanying drawings.

In FIGS. 1–8, there is shown a centralizer segment 1 comprising a first collar portion 3, a second collar portion 5, bows 7 extending between the first and second collar portions 3 and 5, first connectors 9 and second connectors 11.

Two or more centralizer segments 1 may be connected together via the first and second connectors 9 and 11, as will be further described herein.

A first connector 9 is provided on the first collar portion 3 and on the second collar portion 5.

The first connectors 9 are provided on a first face 10 of the centralizer segment 1.

Each first connector 9 is provided as a series of teeth 13. The teeth 13 of the first connectors 9 extend on the first collar portions 3 and 5, respectively, from respective first ends 15 thereof. The series of teeth 13 terminate before the location at which a bow 7 extends between the first and second collar portions 3 and 5.

Each second connector 11 is provided as a guide 24 and a series of pawls 19 adjacent respective second ends 21 of the collar portions 3 and 5. Each guide 24 consists of s series of L-shaped lugs 24A extending on each side of the pawls 19 in an opposed manner.

The second connectors 11 are provided on a second face 17 of the centralizer segment 1.

The teeth 13 and pawls 19 of the first and second connectors 9 and 11. respectively, form a pawl and ratchet connection arrangement. This allows the relative positional engagement between the first and second connectors 9 and 11 to be selected as will be further described later herein.

The first and second collar portions 3 and 5 are provided as strap-like members and are substantially parallel to one another.

The bows 7 extend between the first and second collar portions 3 and intermediate the locations of the first and second connectors 9 and 11 on the first and second collar portions 3 end 5.

The bows 7 have an inbuilt curvature in their longitudinal direction, in which they extend, between the first and second collar portions 3 and 5. This can be best seen in FIGS. 5 and 7.

The bows 7 are strap-like members. The bows 7 are flexibly resilient.

The bows 7 are provided with rib members 22 on the first face 10 of the centralizer segment 1 that, in use, faces the borehole casing. The rib members 22 extend diagonally across the width of the bows 7 for substantially the length of the bows 7.

The rib members 22 are each provided with an enlarged portion 22*a*. The enlarged portion 22*a* is provided midway along the length of each rib member 22.

A pair of lugs 23 is provided on each of the first and second collar portions 3 and 5. The lugs 23 are provided on the second face 17 of the centralizer segment 1 that, in use, faces away from the borehole casing. One of the lugs 23 on each collar portion 3 and 5 is located adjacent the respective first ends 15 of the collar portions 3 and 5. The other lug 23 on each collar portion 3 and 5 is located approximately midway along the length of the respective collar portions 3 and 5.

Slots 25 are provided in the collars 3 and 5. The slots 3 and 5 increase the flexibility of the collars 3 and 5 and save on the raw material from which the centralizer segment 1 is made, However, the slots 25 may, alternatively, be omitted.

The centralizer segment 1 is made of a corrosion resistant material. The manner of operation and use of the centralizer segment 1 of the present invention will now be described.

Figure 9:
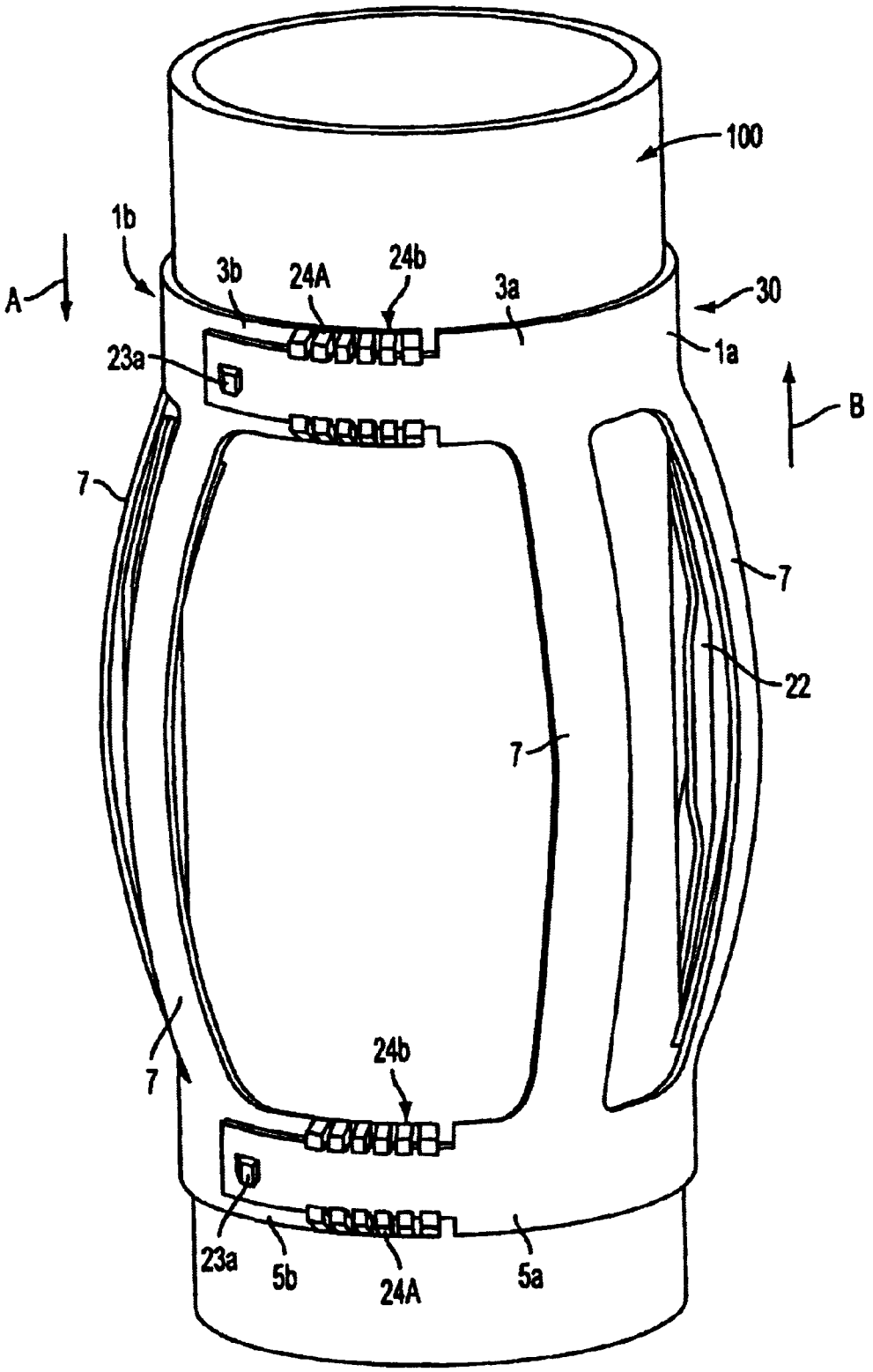
FIG. 9 is a perspective view of two centralizer segments joined together to form a centralizer around a borehole casing.
Figure 10:
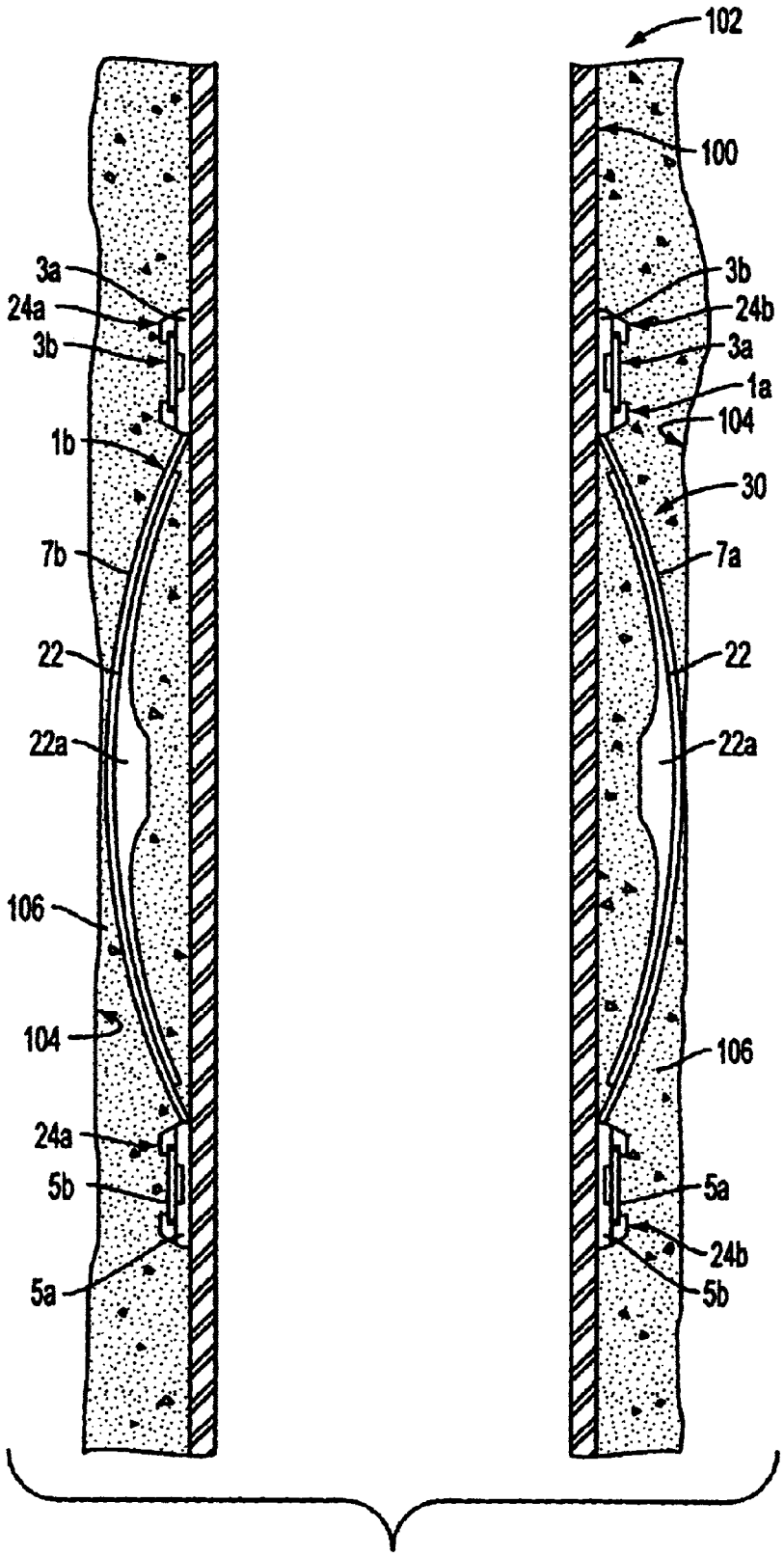
FIG. 10 is a cross sectional view of a borehole having a borehole casing therein with a centralizer located thereon.
Figure 11:
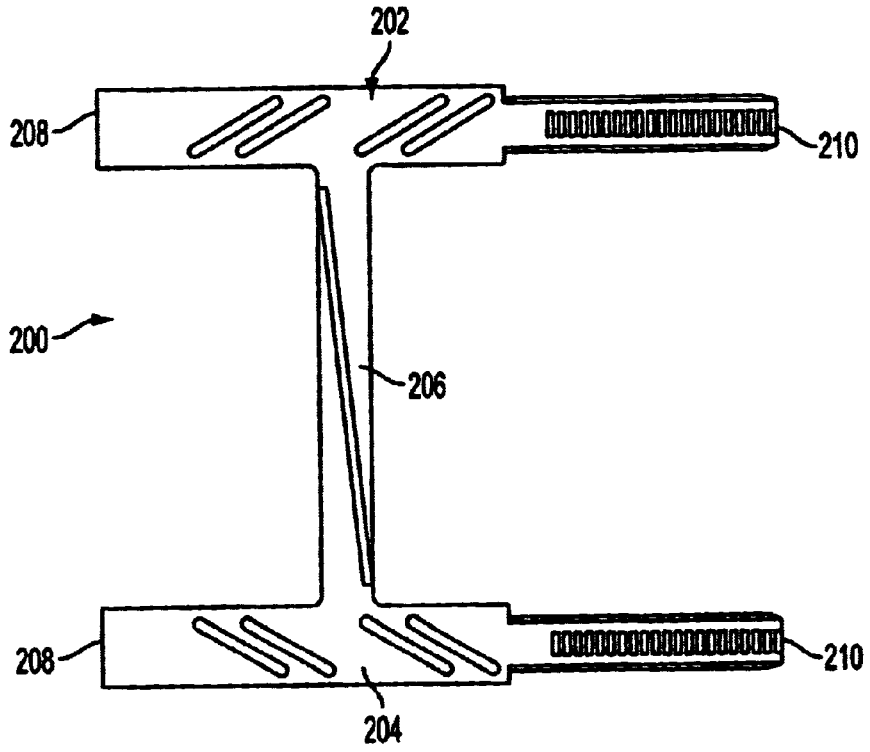
FIG. 11 is an embodiment of a centralizer segment according to one aspect of the present invention.
Figure 12:
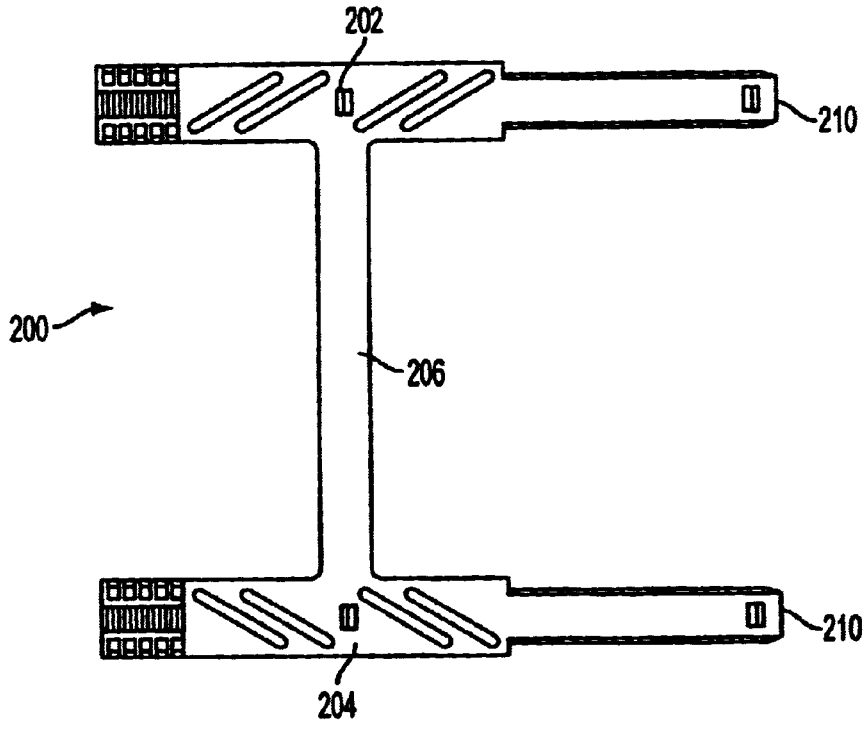
FIG. 12 is plan view of the centralizer segment as shown in FIG. 11.

Two or more centralizer segments 1 are able to be connected together via the first and second connectors 9 and 11 to form a centralizer 30 shown in FIGS. 9 and 10. In FIGS. 9 and 10, the centralizer 30 is formed of two centralizer segments 1*a* and 1*b*, respectively, connected together around a borehole casing 100. This is done by inserting the ends 15 of the first and second collar portions 3 and 5 of the first centralizer segment 1*a* beneath and between the opposed L-shaped lugs 24A of the guides 24 of the second connectors 11 of the second centralizer segment 1*b*. This causes the teeth 13 of the first connectors 9 of the first centralizer segment 1*a* to engage with the pawls 19 of the second connectors 11 of the second centralizer segment 1*b*. Similarly, the ends 15 of the first and second collar portions 3 and 5 of the second centralizer segment 1*b* are inserted beneath and between the opposed L-shaped lugs 24A of the guides 24 of the second connectors 11 of the first centralizer segment 18. This causes the teeth 13 of the first connectors 9 of the second centralizer segment 1*b* to engage with the pawls 19 of the second connectors 11 of the first centralizer segment 1*a*. The above described procedure is carried out with the centralizer segments 1*a* and 1*b* positioned around the borehole casing 100.

The teeth 13 of the first connectors 9 of the first centralizer segment 1*a* engage with pawls 19 of the second connectors 11 of the second centralizer segment 1*b*. This can be seen in FIG. 9. Similarly, the teeth 13 of the first connectors 9 of the second centralizer segment 1*b* engage with pawls 19 of the second connectors 11 of the first segment 1*a*. This, however, is obscured in FIG. 9 by the borehole casing 100.

The connections between the first and second centralizer segments 1*a* and 1*b* can be adjusted by using a tool, such as a pair of pliers, to grip the lugs 23*a* adjacent the ends 15 of the first centralizer segment 1*a* and the lugs 23*b* located midway along the length of the collar portions 3 and 5 of the second centralizer segment 1*b* to thereby pull the collar portions 3*a* and 5*a* of the first centralizer segment 1*a* further through the guides 24*b* of the collar portions 3*b* and 5*b* of the second centralizer segment 1*b*. In this way, the first and second centralizer segments 1*a* and 1*b*, that form the centralizer 30, can be tightened around the borehole casing 100.

The ability to pull the collar portions 3 and 5 of one centralizer segment 1 through the guides 24 of another centralizer segment 1 until the centralizer 30 is tightly affixed around the borehole casing 100 means that the relative positional engagement between the first and second connectors 9 and 11 can be selected to achieve the required tightness. Additionally, it means that a centralizer, whether made up of one or more centralizer segments according to the present invention, can be adjusted to fit a range of borehole casings 100 of differing diameters.

If the borehole casing 100 is of a large diameter such that it cannot be surrounded by a pair of centralizer segments 1, then three or more centralizer segments may be connected together via the first and second connectors 9 and 11 around the borehole casing 100.

A centralizer 30 is fixed around a borehole casing 100 prior to the borehole casing 100 being inserted into a borehole 102. A borehole casing 100 is generally made by connecting casing lengths together as the borehole casing 100 is inserted deeper into the borehole 100. Typically, these casing lengths may be six or nine meters in length. A centralizer 30 may be provided every few meters along the length of the borehole casing 100.

The amount of curvature in the bows 7 of the centralizer segments 1 forming a centralizer 30 can be varied to accommodate the clearance in the borehole 102 into which the borehole casing 100 is being inserted. This is done by first affixing one collar of the centralizer 30 around the borehole casing 100. Using the centralizer 30 in FIG. 9 as an example, the collar portions 5*a* and 5*b* of the first and second centralizer segments 1*a* and 1*b* may first be tightly affixed together around the borehole casing 100 to form a first collar of the centralizer 30. If an increased curvature in the bows 7 is required, then the collar portions 3*a* and 3*b* are pushed downwardly along the borehole casing 100, in the direction of arrow A, before they are firmly affixed around the borehole casing 100, pushing the collar portions 3*a* and 3*b* in the direction of arrow A. Towards the collar portions 5*a* and 5*b*, will increase the curvature of the bows 7. Pulling the collar portions 38 and 3*b* upwardly, in the direction of arrow B will lessen the curvature of the bows 7.

FIG. 10 shows a borehole casing 100 in position in a borehole 102 with a centralizer 30 affixed around the borehole casing 100. The bows 7 of the centralizer segments 1 which form the centralizer 30 contact the wall 104 of the borehole 102.

Due to the bows 7 being flexibly resilient, as the borehole casing 100 is pushed into the borehole 102, the bows 7 deform if they encounter any obstruction in the wall 104 of the borehole 102. Furthermore, once the bows 7 pass over the obstruction, they will return to their normal undeformed position to maintain contact with the wall 104 of the casing 100.

Maintaining the bows 7 in contact with the wall 104 of the borehole 102 ensures that the borehole casing 100 remains centralised as it is pushed further down into the borehole 102.

The enlarged portions 22*a* of the rib members 22 ensure that, in the event of a collapse of the wall 104, a minimum clearance is retained between the bows 7 and the borehole casing 100. This minimum clearance is determined by the thickness of the enlarged portions 22*a*.

Once the borehole casing 100 is in position in the borehole 102, a grout discharge pipe can be lowered down the borehole casing 100. Grout is then discharged from the opening of the grout discharge pipe so that it flows into the annular space between the borehole pipe 100 and the wall 104 of the borehole 102. The grout then flows upwardly in the annular space and fills the annular space with grout as shown by reference numeral 106.

The ribs 22 of the centralizer segments 1 promote the direction of the flow of grout entering into the space between the bows 7 and the bore hole casing in order to achieve an even filling of the annular space by the grout without channels and cavities.

Once the grout 106 has set, the borehole casing 100 remains centralised in the borehole 102 and can be used for its intended purpose.

The centralizer according to the second embodiment of the present invention is used in a similar manner to the centralizer according to the first embodiment of the present invention, except that the centralizer of the second embodiment is used with borehole casings having a relatively small diameter such that only a single centralizer segment is used to form the centralizer around the borehole casing. Accordingly, in the second embodiment of the centralizer, the centralizer segment used has its first connector 9 on the first collar portion 3 connected to the second connector 11 on the first collar portion 3 and the first connector 9 on the second collar portion 5 is connected to the second connector 11 on the second collar portion 5.

In addition, if required, two or more centralizer segments that are used to form a centralizer according to the second embodiment may be connected together around a borehole casing to form a centralizer in similar manner to the centralizer segment 1 that is used to form a centralizer according to the first embodiment of the present invention. However, the centralizer segment 1 intended to form a centralizer for medium to large diameter borehole casings would usually be too large to be used to form a centralizer formed of only a single centralizer segment on a small diameter borehole casing. Modifications and variations such as would be apparent to a skilled addressee are deemed to be within the scope of the present invention.

Throughout the specification, unless the context requires otherwise, the word "comprise" or variations such as "comprises" or "comprising", will be understood to imply the inclusion of a stated integer or group of integers but not the exclusion of any other integer or group of integers.

I claim:

1. A bore casing centralizer segment comprising:

a plurality of substantially arcuate bows;

each of said bows having a first collar portion being of substantially elongate configuration fixedly connected to a first end of said bow;

each of said bows having a second collar portion being of substantially elongate configuration fixedly connected to a second end of said bow;

each of said first collar portions being substantially parallel to said second collar portions;

first connectors provided at a first end of each of said first collar portions and a first end of each of said second collar portions;

second connectors provided at a second end of each of said first collar portions and a second end of each of said second collar portions;

wherein each of said first connectors engages one of said second connectors such that at least two of said centralizer segments are connectable together to form a centralizer which can be located around a borehole casing.

2. Centralizer segment according to claim 1, wherein said first and second connectors are such that when interconnected allow the relative longitudinal movement between the respective ends of the respective collar portions to reduce the diameter of the centralizer but will resist relative longitudinal movement between the respective ends of the respective collar portions to increase the diameter of the centralizer.

3. Centralizer segment according to claim 2, wherein said bows extend between said first and second collar portions intermediate the locations of said first and second connectors.

4. Centralizer segment according to claim 2, wherein said first and second collar portions are provided with lug members on a face of said centralizer segment that in use, faces away from the borehole casing.

5. Centralizer segment according to claim 2, wherein said first connectors comprises a series of axially spaced teeth provided on said first and second collar portions on a first face of said centralizer segment and said second connectors comprises one or more axially spaced pawls provided on said first and second collar portions on a second face of said centralizer segment.

6. Centralizer segment according to claim 5 , wherein said second connector further comprises guide means for receiving the interengaged first and second collar portions.

7. Centralizer segment according to claim 5, wherein said bows extend between said first and second collar portions intermediate the locations of said first and second connectors.

8. Centralizer segment according to claim 5, wherein said first and second collar portions are provided with lug members on a face of said centralizer segment that in use, faces away from the borehole casing.

9. Centralizer segment according to claim 2, wherein said second connectors further comprise guides for receiving the interengaged first and second collar portions.

10. Centralizer segment according to claim 9, wherein said bows extend between said first and second collar portions intermediate the locations of said first and second connectors.

11. Centralizer segment according to claim 1, wherein said first and second collar portions are provided with lug members on a face of said centralizer segment that in use, faces away from the borehole casing.

12. Centralizer segment according to claim 1, wherein said bow means is flexibly resilient.

13. Centralizer segment according to claim 1, wherein said bow means is curved in the direction between said first and second collar portions.

14. Centralizer segment according to claim 1, wherein said bow extends between said first and second collar portions intermediate the locations of said first and second connectors.

15. Centralizer segment according to claim 1, wherein flow directing elements are provided on said centralizer segment to aid in the direction of the flow of grout injected into the region of a borehole accommodating the centralizer.

16. Centralizer segment according to claim 15, wherein said flow directing elements comprise rib members provided on said bow means.

17. Centralizer segment according to claim 16, wherein said rib members are provided on a face of said centralizer segment that, in use, faces the borehole casing, said rib members being offset form the axis of the bow members.

18. Centralizer segment according to claim 16, wherein at least one of said rib members is provided with at least one enlarged portion.

19. Centralizer segment according to claim 1, wherein said bow has a strap-like configuration between said first and second collar portions.

20. Centralizer segment according to claim 1, wherein said first and second collar portions are substantially parallel.

21. Centralizer segment according to claim 1, wherein said first and second collar portions are provided as strap members.

22. Centralizer segment according to claim 1, wherein said centralizer segment is made of a corrosion resistant material.

23. A bore casing centralizer comprising a centralizer segment according to claim 1, having the ends of the respective collar portions interconnected via said first and second connectors.

24. Centralizer segment according to claim 23, wherein said centralizer comprises at least two centralizer segments connected together via said first and second connection means around a borehole casing.

25. A bore casing centralizer comprising at least two centralizer segments according to claim 1, interconnected in end to end relationship by having the ends of the respective collar portions interconnected via said first and second connectors.

26. Centralizer segment according to claim 1, wherein said centralizer segment is made of a flexibly resilient corrosion resistant material.

27. Centralizer segment according to claim 1, wherein said collar portions are fixedly interconnected to the respective ends of the bows.

* * * * *